US007516563B2

(12) United States Patent
Koch

(10) Patent No.: US 7,516,563 B2
(45) Date of Patent: Apr. 14, 2009

(54) EXCAVATION CONTROL SYSTEM PROVIDING MACHINE PLACEMENT RECOMMENDATION

(75) Inventor: Roger D. Koch, Pekin, IL (US)

(73) Assignee: Caterpillar Inc., Peoria, IL (US)

( * ) Notice: Subject to any disclaimer, the term of this patent is extended or adjusted under 35 U.S.C. 154(b) by 49 days.

(21) Appl. No.: 11/605,949

(22) Filed: Nov. 30, 2006

(65) Prior Publication Data

US 2008/0133128 A1 Jun. 5, 2008

(51) Int. Cl.
*E02F 5/02* (2006.01)

(52) U.S. Cl. ..... 37/348; 37/414; 37/379; 701/50

(58) Field of Classification Search ..... 37/348, 37/379, 435, 443, 414; 701/50; 172/2–5
See application file for complete search history.

(56) References Cited

U.S. PATENT DOCUMENTS

| | | | | |
|---|---|---|---|---|
| 5,065,326 | A | 11/1991 | Sahm | |
| 5,631,658 | A * | 5/1997 | Gudat et al. | 342/457 |
| 5,646,844 | A | 7/1997 | Gudat et al. | |
| 5,964,298 | A | 10/1999 | Greenspun | |
| 6,064,926 | A | 5/2000 | Sarangapani et al. | |
| 6,076,030 | A | 6/2000 | Rowe | |
| 6,223,110 | B1 | 4/2001 | Rowe et al. | |
| 6,236,924 | B1 | 5/2001 | Motz et al. | |
| 6,247,538 | B1 | 6/2001 | Takeda et al. | |
| 6,282,477 | B1 | 8/2001 | Gudat et al. | |
| 6,363,632 | B1 * | 4/2002 | Stentz et al. | 37/414 |
| 6,437,726 | B1 * | 8/2002 | Price | 342/22 |
| 6,735,888 | B2 * | 5/2004 | Green et al. | 37/348 |
| 6,766,600 | B2 | 7/2004 | Ogura et al. | |
| 7,113,105 | B2 * | 9/2006 | Sahm et al. | 340/679 |
| 2004/0210370 | A1 * | 10/2004 | Gudat et al. | 701/50 |

FOREIGN PATENT DOCUMENTS

| | | | |
|---|---|---|---|
| JP | 10 088 625 | A | 4/1998 |

* cited by examiner

*Primary Examiner*—Thomas A Beach
*Assistant Examiner*—Matthew R Buck
(74) *Attorney, Agent, or Firm*—Finnegan, Henderson, Farabow, Garrett & Dunner

(57) ABSTRACT

A control system for a machine operating at a excavation site is disclosed. The control system may have a positioning device configured to determine a position of the machine, and a controller in communication with the positioning device. The controller may be configured to receive information regarding a predetermined task for the machine, receive the machine's position, and receive a location of an obstacle at the excavation site. The control system may also be configured to recommend placement of the machine to accomplish the predetermined task based on the received machine position and obstacle location.

20 Claims, 8 Drawing Sheets

EXCAVATION CONTROL SYSTEM PROVIDING MACHINE PLACEMENT RECOMMENDATION

TECHNICAL FIELD

The present disclosure is directed to an excavation control system and, more particularly, to an excavation control system that provides machine placement recommendations.

BACKGROUND

Excavation machines such as, for example, backhoes, tracked excavators, front shovels, trenchers, and other machines known in the art are often used to remove earthen material from around obstacles either to dig to the obstacles or to dig in spite of the obstacles so as not to disturb the obstacles. These obstacles may include, among other things, underground utilities including power lines, gas pipelines, and pressurized water conduits; oil and/or fuel storage tanks; large boulders; and other similar obstacles. When excavating in the vicinity of these obstacles, it may be difficult to position the excavation machine such that productive amounts of material may be removed before repositioning of the machine is required. In addition, some of the material near the obstacle may, because of linkage constraints of the machine, only be removed from particular attack points. If attempts are made to remove the material from positions other than these particular attack points, damage to the machine and/or obstacle may occur. These problems may be exacerbated when an inexperienced operator is in control of the machine and/or when view of the obstacle is obstructed (e.g., when the obstacle is buried below the work surface).

One way to improve material removal from near an unseen object may be to provide to an operator of the machine a visual representation of the object relative to the machine. An implementation of this strategy is disclosed in U.S. Patent Application No. 2004/0210370 (the '370 publication) by Gudat et al., published on Oct. 21, 2004. Specifically, the '370 publication discloses a method of providing a display in real time of an excavation site having underground obstacles. The method includes determining a location of an earthworking machine in site coordinates, determining a location of an earthworking implement relative to the earthworking machine, determining the location in site coordinates of at least one underground object at the excavation site, and responsively inputting the location of the at least one underground object to a terrain map of the excavation site. The method further includes displaying the terrain map including the location of the earthworking machine, the location of the earthworking implement, and the location of the at least on underground object in real time. The '370 publication also discloses that the earthworking machine may include a controller adapted to control the operation of the earthworking implement relative to the location of the underground obstacles, preferably for the purpose of preventing the earthworking implement from contacting the underground obstacles.

Although the method and controller of the '370 publication may improve material removal near underground obstacles by visually displaying the obstacles relative to the earthworking machine and by preventing collisions between the obstacles and machine, they may be limited. In particular, even with a visual display of the obstacles and collision prevention, it may still be difficult to properly position the machine and/or implement for efficient removal of the material. That is, depending on the location and configuration of the object(s), an operator, especially an inexperience operator, may have to reposition the machine many times to remove all of the necessary material. In some situations, the operator may even be required to exit the machine and remove the final amounts of material by hand. Continually repositioning the machine and/or removing the material by hand can be inconvenient and inefficient.

The excavation control system of the present disclosure solves one or more of the problems set forth above.

SUMMARY OF THE INVENTION

One aspect of the present disclosure is direct to a control system for a machine operating at a excavation site. The control system may include a positioning device configured to determine a position of the machine, and a controller in communication with the positioning device. The controller may be configured to receive information regarding a predetermined task for the machine, receive the machine's position, and receive a location of an obstacle at the excavation site. The control system may also be configured to recommend placement of the machine to accomplish the predetermined task based on the received machine position and obstacle location.

Another aspect of the present disclosure is directed to a method of controlling an excavating machine having an earthmoving work implement. The method may include determining a position of the excavating machine, and determining a location of an obstacle. The method may also include receiving information regarding a predetermined task for the excavating machine. The method may further include recommending placement of the excavating machine to accomplish the predetermined task based on the received machine position and obstacle location.

DETAILED DESCRIPTION

Figure 1:
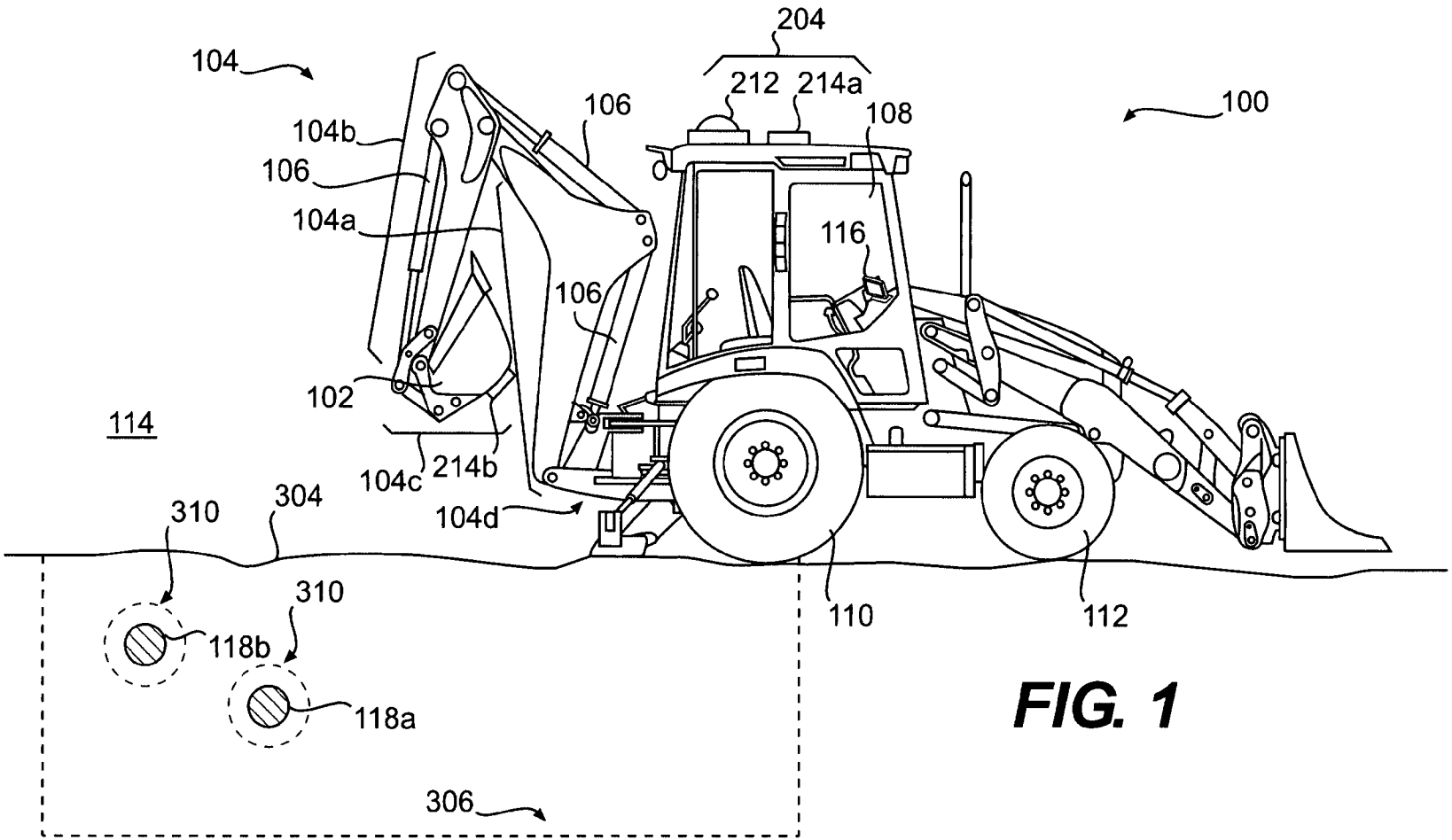
FIG. 1 is a side-view pictorial illustration of an exemplary disclosed excavation machine.

FIG. 1 illustrates an exemplary machine 100 for use in industries such as mining, construction, farming, transportation, or any other industry known in the art. Machine 100 may be, for example, a backhoe, a dozer, a loader, an excavator, a motor grader, a dump truck, or any other excavating machine known in the art. Machine 100 may include an earthmoving implement 102, such as a bucket, a shovel, a blade, a fork-arrangement, a grasping device, and the like. Implement 102 may be operably connected to machine 100 by way of a linkage system 104 comprising one or more interconnected arm members 104*a-d*.

One or more actuators 106 may be operably interconnected between arm members 104*a-d* to position and/or orient implement 102 with respect to machine 100 in a preferred manner. Actuators 106 may include, for example, one or more of a hydraulic or pneumatic cylinder, a pump, a motor, or any other type of actuator known in the art. Machine 100 may further include an operator cabin 108, a driven traction device 110, and a steerable traction device 112 for propelling machine 100, such as, for example, wheels, tracks, belts or other driven traction devices known in the art. Actuators 106 may be moved in response to operator input to perform some type of work at an excavation site 114.

Operator cabin 108 may be an enclosure that houses a machine operator interface. The operator interface may include a seat and one or more operator control devices located in proximity to the seat. An operator may use the operator control devices to control functions of machine 100, such as, for example, to position and orient implement 102, and control driven traction device 110, and/or steerable traction device 112 to remove earthen material from excavation site 114. Operator cabin 108 may or may not be substantially sealed from environmental conditions in which work machine 100 operates.

Operator cabin 108 may further include a monitor 116 configured to responsively and actively display a location of machine 100, a location of implement 102 and/or linkage system 104, and/or excavation site 114. Monitor 114 may be configured to display other information relevant to machine functionality or operation to the operator. Monitor 114 may include, for example, a liquid crystal display (LCD), a CRT, a PDA, a plasma display, a touch-screen, a portable hand-held device, or any such display known in the art.

Excavation site 114 may include underground obstacles 118, such as, for example, electrical, telephone and/or gas utility lines; supply pipes; storage tanks; rock; and the like. FIG. 1 depicts two underground obstacles 118*a*, 118*b*. However, any number of underground obstacles 118 may exist in the proximity of the excavation work. It is highly desired to avoid interference with the underground obstacles 118 during excavation. For example, it may be desired to dig in close proximity to, and without damaging, existing underground obstacles 118 for the purpose of adding new underground obstacles 118, performing repairs and maintenance on existing underground obstacles 118, or to otherwise perform excavation for purposes unrelated to the underground obstacles 118 themselves, such as digging a foundation, or a road.

Figure 2:
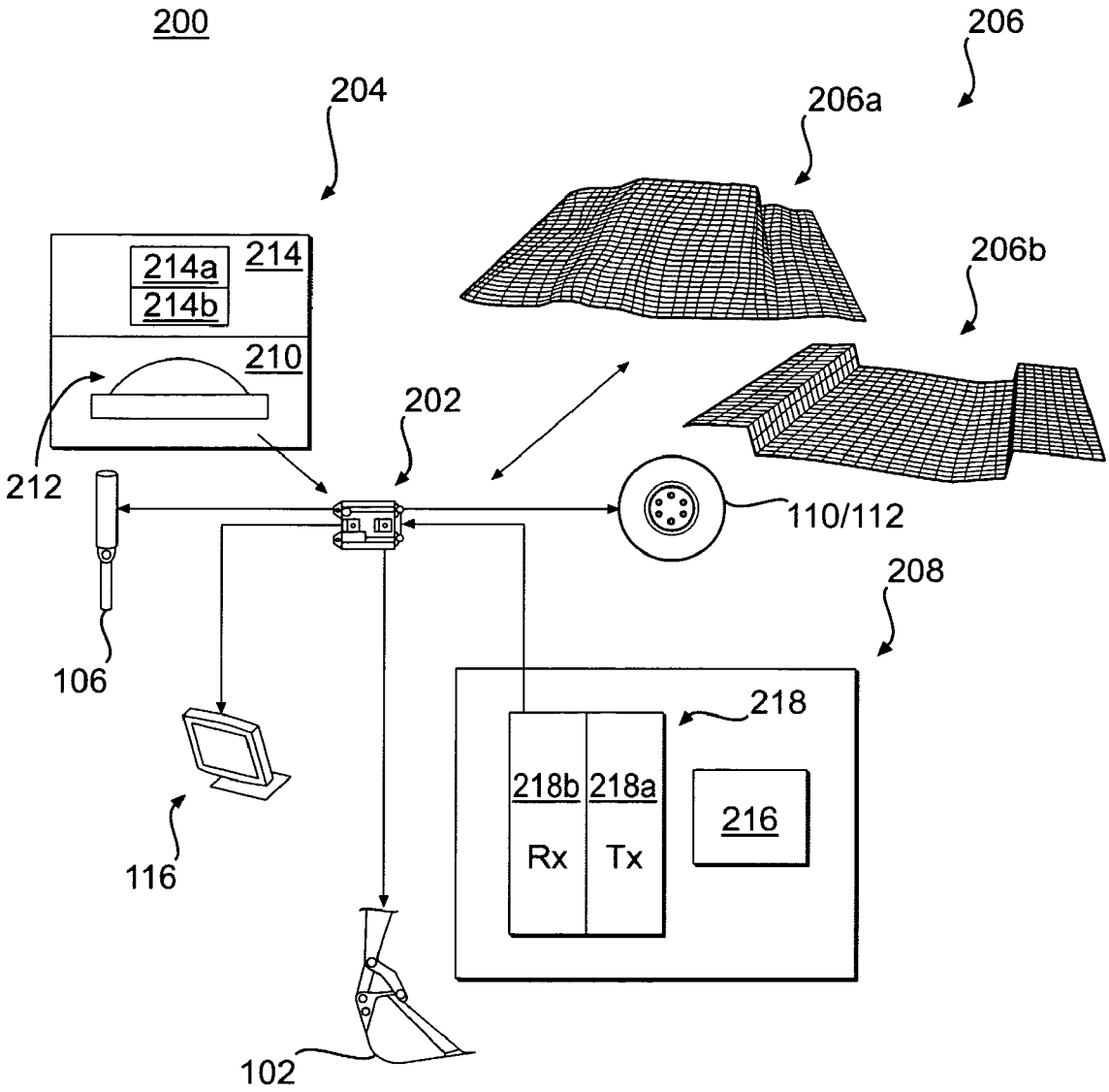
FIG. 2 is a schematic and diagrammatic illustration of an exemplary disclosed control system for use with the excavation machine of FIG. 1.

FIG. 2 shows an exemplary disclosed excavation control system 200. Control system 200 may include a controller 202 operably connected to and in communication with a machine position determining system 204, a terrain map 206, an obstacle location detection system 208, and monitor 116. Controller 202 may also be operably connected to and configured to control, by way of actuators 106, implement 102. Controller may be further operably connected and configured to control driven and/or steerable traction devices 110 and 112.

In one disclosed embodiment, controller 202 may include a single microprocessor or multiple microprocessors for controlling operations or functions of control system 200 and/or machine 100. Numerous commercially available microprocessors may be configured to perform the functions of controller 202. Further, the microprocessors may be general-purpose or specially-constructed for a specific purpose. It should be appreciated that controller 202 may readily embody a computer capable of controlling numerous machine functions. The microprocessors may store information related to system 200 in hardware, software, firmware, or instructions.

In one aspect, communication between controller 202 and the other elements of control system 200 may be facilitated by the use of network architecture. Network architecture may include, alone or in any suitable combination, a telephone-based network (such as a PBX or POTS), a local area network (LAN), a wide area network (WAN), a dedicated intranet, and/or the Internet. Further, the network architecture may include any suitable combination of wired and/or wireless components. For example, the communication links may include non-proprietary links and protocols, or proprietary links and protocols based on known industry standards, such as J1939, RS-232, RP1210, RS-422, RS-485, MODBUS, CAN, SAEJ1587, Bluetooth, the Internet, an intranet, 802.11b or g, or any other communication links and/or protocols known in the art.

Controller 202 may further include a computer-readable medium or memory, a secondary storage device, and any other components for running an application. The computer-readable memory may be implemented with various forms of memory or storage devices, such as read-only memory (ROM) devices and random access memory (RAM) devices such as flash memory. The secondary storage device may comprise memory tape, a disk drive, or an integrated circuit (IC) for storing and providing data as input to and output from controller 202. The memory, the secondary storage device, and/or the microprocessors may store information related to the function of control system 200. In an exemplary embodiment, the information may be stored in hardware, software, or firmware within the memory, the secondary storage device, and/or the microprocessors.

Machine position determining system 204 may be located on machine 100 and adapted to determine a location, in site coordinates, of machine 100, and provide signals to be received by controller 202 indicating the determined location thereof. For example, as shown in FIG. 2, position determining system 204 may include a global positioning satellite (GPS) system 210 having a GPS antenna 212. GPS antenna 212 may receive one or more signals from one or more satellites. Based on the trajectories of the one or more signals, system 204 may be able to determine a position of machine 100 in site coordinates. However, it is to be appreciated that system 204 may employ other methods to determine the location of machine 100, such as, for example, laser plane referencing and the like.

Moreover, position determining system 204 may be further adapted to determine a location of implement 102 and provide signals to be received by controller 202 indicating the determined location thereof. For example, the location of implement 102 relative to the machine 100 may be determined by the use of one or more position sensors 214 located on machine 100. A transmitter 214*a* may be located on operator cabin 108 and configured to broadcast a signal. A receiver 214*b* may be located on implement 102 and configured to receive the broadcasted signal. Based on one or more characteristics of the received signal, system 204 may be able to determine a three-dimensional location of implement 102 relative to transmitter 214*a*. Subsequently, system 204 may then determine the position of implement 102 in site coordinates by comparing the determined location of implement 102 with respect to transmitter 214*a*, with the determined machine position discussed above. In another aspect, receiver 214*b* may be a GPS antenna, and the position of implement 102 in site coordinates may be directly determined independently of the position of machine 100. Alternatively, transmitter 214*a* may be in a remote location on excavation site 114, and the position of implement 102 in site coordinates may be determined with respect to the remote location. In a further aspect, system 204 may determine the location of implement 102 by use of cylinder extension and/or retraction sensors (not shown) associated with actuators 106, in conjunction with known geometry and/or kinematics of implement 102 and/or linkage system 104, to calculate the position of implement 102 in site coordinates. It is to be appreciated that other position determining arrangements known in the art may be employed alternatively or additionally.

Terrain map 206 may provide signals to be received by controller 202 indicative of information relevant to the terrain of excavation site 114. For example, terrain map 206 may include work surface data describing ground elevation and/or earthen material composition, consistency, etc., at various locations on excavation site 114. Further, terrain map 206 may include information pertaining to a predetermined excavation task, such as, for example, specifications and/or plan lines delineating a desired excavation result in site coordinates (i.e. a foundation of predetermined dimensions to be dug). Controller 202 may also provide real-time updates to terrain map 206, including changes made to the terrain at site 114 as excavation takes place. In other words, as implement 102 removes material from a location on site 114, terrain map 206 may be updated, based on the positions of implement 102, to show a reduced elevation thereof accordingly. For example, prior to excavation, the terrain at site 114 may be defined in site coordinates as shown by initial terrain map 206*a*. Upon completion of excavation, such as, for example, digging a foundation of predetermined dimensions, the terrain at site 114 may be defined in site coordinates as shown by final terrain map 206*b*. Preferably, terrain map 206 may be embodied as a database accessible by controller 202.

Obstacle location detection system 208 may determine a location, geometry, condition, and/or composition of underground obstacles 118, and provide corresponding signals to be received by controller 202. In one embodiment, system 208 may include a pre-existing map 216. Pre-existing map 216 may include schematic information about excavation site 114 from a prior installation of the underground obstacles 118 (i.e. created when underground obstacles 118 were initially installed; or generated from a prior sensing of the location of underground obstacles 118). Pre-existing map 216 may also include information regarding a composition and/or condition of obstacles 118, such as, for example, a material comprising obstacles 118 and/or an age thereof. Pre-existing map information may be stored in system 208 and/or in controller 202 as hardware, software, and/or firmware within the microprocessors, memory, and/or secondary storage devices and/or accessible by controller 202. Preferably, pre-existing map 216 may embody a database compatible with terrain map 206.

Alternatively and/or additionally, location detection system 208 may include sensing devices for determining the location of underground obstacles 118. For example, a ground-penetrating radar (GPR) system 218 having a GPR transmitter 218*a* and a GPR receiver 218*b* may be used. GPR system 218 may be located on machine 100, or externally thereto and used independently of machine 100. For example, GPR system 218 may be positioned on top of operator cabin 108, on implement 102, or in a remote location on excavation site 114. In one aspect, a location of obstacle 118 may be determined based on a known dielectric constant of the ground in between implement 102 and obstacle 118. GPR transmitter 218*a* may broadcast a probing signal into the ground, which may then reflect off of obstacle 118 and be detected by GPR receiver 218*b*. Based on a measured velocity of the reflected probing signal and the known dielectric constant, location detection system 208 and/or controller 202 may determine a location of obstacle 118 in site coordinates. Further, based on properties of the reflected probing signal, detection system 208 and/or controller 202 may be adapted to determine a geometry of underground obstacles 118. To a degree, detection system 208 and/or controller 202 may also be able to estimate a condition and/or composition of obstacle 118 based on properties of the reflected probing signal. Alternatively, system 208 may include other technologies, such as acoustic, ultrasound, and the like.

Figure 3:
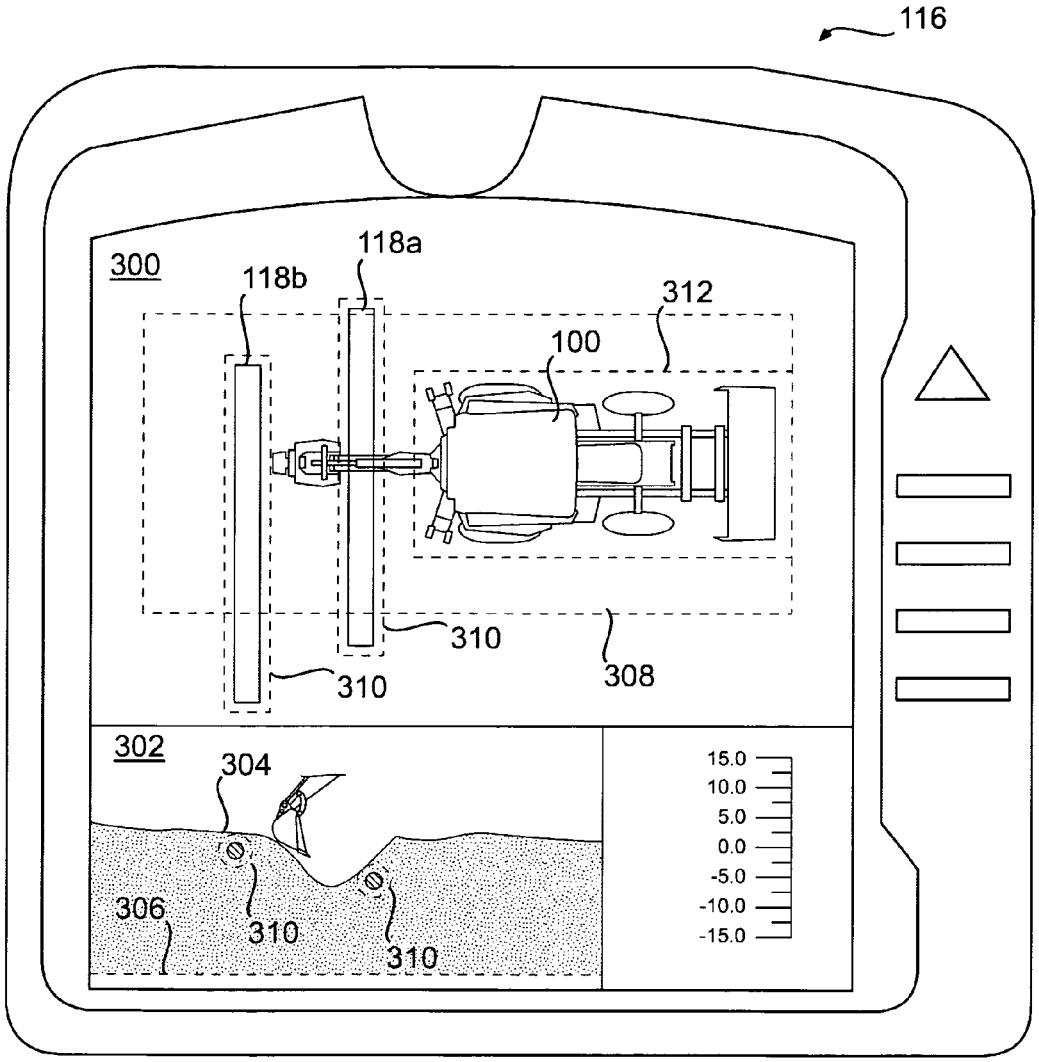
FIG. 3 is a diagrammatic illustration of graphical user interface for use with the excavation machine of FIG. 1.

An exemplary monitor 116 is illustrated in FIG. 3. Preferably, monitor 116 may be adapted to show more than one view of excavation site 114, such as, for example, an overhead view 300 and a side-profile view 302. Further, monitor 116 may indicate, in addition to current work surface terrain 304, a desired terrain 306. Current terrain 304 and desired terrain 306 may provide an operator of machine 100 with a reference for comparison, as well as an indication of excavation progress. An icon or image of machine 100 and implement 102 may be provided on monitor 116 to indicate locations thereof with respect to excavation site 114. In addition, plan lines 308 delineating a predetermined excavation task may be displayed on monitor 116 in order to indicate to the operator where excavation is to take place.

Preferably, various regions in overhead view 300 may be shaded, color-coded, cross-hatched, gray-scaled, or otherwise graphically distinguished to indicate a depth of the current work surface terrain 304 relative to the desired terrain 306. For example, current terrain 304 that is higher than desired terrain 306 may be shown as a first color, current terrain 304 that is lower than desired terrain 306 may be shown as a second color, and current terrain 304 that is at the same level as desired terrain 306 may be shown as a third color. As such, the operator may easily observe the progress of excavation relative to a desired final result indicated by desired terrain 306.

Preferably, controller 202 may establish a tolerance zone 310 surrounding underground obstacles 118 based on the signals received from obstacle location detection system 208 and graphically indicate tolerance zone 310 on monitor 116. Tolerance zone 310 may define a protective buffer surrounding underground obstacles 118 in which implement 102 and/or linkage system 104 may not be permitted to enter during excavation, in order to prevent damage to obstacles 118. A size, shape, thickness, and/or other information pertaining to tolerance zone 310 may be based the durability of obstacle 118. Tolerance zone 310 may also help to prevent damage to implement 102 and/or linkage system 104 during excavation.

In one aspect, information regarding tolerance zone 310 may be based on a predicted force magnitude and force direction that may be transmitted into tolerance zone 310 and/or obstacle 118 by implement 102 and/or linkage system 104 during completion of an excavation pass (i.e. an amount of force that may be applied to tolerance zone 310, and by implication, obstacle 118 itself, when implement 102 and/or linkage system 104 impacts tolerance zone 310). For example, when digging toward obstacle 118 with a high force, controller 202 may establish a larger and/or thicker tolerance zone than when digging away from obstacle 118, or toward obstacle 118 with a low force. Particularly, controller 202 may determine a force magnitude and force direction that may cause damage to obstacle 118 (i.e. maximum force threshold), and tailor tolerance zone 310 accordingly.

The predicted force magnitude and force direction determination may be based on one or more factors, such as, for example, the composition and/or density of the earthen material surrounding obstacle 118, and/or the type of implement 102 employed by machine 100. For example, if the earthen material is known to be sparse, and implement 102 has a large mass and a relatively small surface area for engaging the earthen material, such as, for example, teeth on a bucket, controller 202 may establish a large and/or thick tolerance zone 310, as a high force magnitude may be applied to obstacle 118. Controller 202 may also predict the force magnitude and force direction based on a force output of actuators 106, in connection with known kinematics and geometry of implement 102 and/or linkage system 104. In one aspect, controller 202 may determine that digging toward obstacle 118 may cause damage to the obstacle 118, even with a small force, and therefore, excavation passes should only be performed in directions substantially away from obstacle 118 in order to prevent damage thereto. Tolerance zone 310 information may be provided to controller 202 by machine position determining system 204, obstacle location detection system 208, and/or manually input by the operator by way of the operator input devices.

In another aspect, tolerance zone 310 may be based on the location, geometry, composition and/or condition of obstacles 118 contained in pre-existing map 216, or received from obstacle location detection system 208. For example, if obstacle 118 is determined to be of a metal composition, such as a water pipe, tolerance zone 310 may define a larger buffer than if obstacle 118 is determined to be rock, due to the risk of breaking the pipe during excavation. Similarly, if obstacle 118 is determined to be of a plastic composition, such as fiber optic cable conduit, tolerance zone 310 may be larger than that for the metal pipe, as a plastic conduit may be more susceptible to damage during excavation. However, it is to be appreciated that if obstacle 118 is determined to be of an extremely hard composition, such as rock, tolerance zone 310 may also be defined such that damage to implement 102, linkage system 104, and/or other components of machine 100 does not occur during excavation. Further, if obstacle 118 is known to be in a good or poor condition, the tolerance zone information may be established accordingly. For example, if obstacle 118 is known to be very old and/or brittle (i.e. a corroding sewage pipe), tolerance zone 310 may define a larger buffer than if obstacle 118 is known to be relatively new and sturdy. Such information may either be entered by the operator as one or more settings through the operator input devices and/or obtained from pre-existing map 216 (i.e. date of prior installation).

In a preferred embodiment, controller 202 may determine, and graphically indicate by way of display on monitor 116, whether a predetermined excavation task, such as an excavation pass (i.e. digging stroke with implement 102), is possible from a given location. For example, controller 202 may recommend that an excavation pass not be attempted by causing a colored, flashing image or icon of machine 100, implement 102, and/or linkage system 104 to appear on monitor 116. Alternatively, an audible warning may be provided to the operator.

Controller 202 may consider whether a predetermined excavation pass is possible based on the received location of obstacles 118, received machine position, received information regarding the predetermined task, received information regarding terrain of the excavation site 114, and known kinematics and geometry of implement 102 and/or linkage system 104. For example, controller 202 may determine whether excavation passes may be made without striking obstacles 118 and/or tolerance zones 310 thereof, and further, if such contact is made, an amount of force that may be applied thereto. In situations where the force may be prohibitively large, controller 202 may prevent such excavation passes from being attempted. Alternatively, controller 202 may recommend to the operator that such excavation passes not be attempted, as discussed above, and then allow the operator to follow or override the recommdation. If the amount of force that may be applied is determined to be sufficiently small, controller 202 may permit the excavation passes. Additionally, controller 202 may determine if a pass may be made without implement 102 and/or linkage system 104 breaching plan lines 308. Further, controller 202 may determine if desired terrain 306 may be achieved from the given machine position (i.e. whether implement 102 may reach a targeted location required by desired terrain 306 and/or plan lines 308). This information may be cumulatively used by controller 202 to determine if an excavation task is possible from a given machine position.

As shown in FIGS. 4A-4D, controller 202 may determine and recommend to the operator, by way of monitor 116, one or more optimum machine placement positions 312*a-d* from which excavation may be efficiently accomplished. Preferably, positions 312*a-d* may be graphically indicated on monitor 116. For example, controller 202 may flash an image or icon of machine 100 in an appropriate position 312*a-d* on monitor 116. In another aspect, controller 202 may show an image or icon of machine 100 traversing a determined path, or otherwise moving from a given position to a recommended position 312*a-d*, on monitor 116. Alternatively, controller 202 may simply cause a box to appear on monitor 116 in the recommended position 312*a-d*. It is to be appreciated that the recommended positions 312*a-d* may be graphically indicated in other illustrative manners.

Controller 202 may determine and recommend positions 312*a-d* based on the received location of obstacles 118, received machine position, received information regarding the predetermined task, received information regarding terrain of the excavation site 114, and known kinematics and geometry of implement 102 and/or linkage system 104. Positions 312*a-d* may be determined, in site coordinates, such that implement 102 may be able to efficiently reach and remove earthen material within targeted regions delineated by plan lines 308. Preferably, positions 312*a-d* may be determined such that machine 100 may be able to remove a maximum amount of earthen material from positions 312*a-d* despite the presence of obstacles 118, and do so efficiently. Specifically, based on terrain information received from terrain map 206, obstacle information received from obstacle location detection system 208, pre-existing map 216, and/or known kinematics of machine 100, controller 202 may be able to calculate a volume of earthen material that may be removed from excavation site 114 from each of a plurality of possible machine positions surrounding plan lines 308. Based on these calculations, controller 202 may select and recommend appropriate positions 312*a-d*, and an order in which they should be visited, to maximize excavation. For example, controller 202 may recommend a first position in which the greatest volume of material may be removed, a second position in which the next greatest volume of material may be removed, etc., such that when machine 100 has visited and performed excavation at all of recommended positions 312*a-d*, desired terrain 306 may be achieved and excavation may be complete. In this manner, excavation within plan lines 308 may be performed without redundantly or incorrectly positioning machine 100.

Although the machine operator may manually position machine 100 at recommended positions 312*a-d* by appropriately manipulating the operator input devices, it is to be appreciated that controller 202 may also move machine 100 to positions 312*a-d* autonomously. For example, controller 202 may receive a current machine position, in site coordinates, from machine position determining system 204, compare the current machine position to the recommended machine position 312*a-d*, and determine a path therebetween according to information about excavation site 114 received from terrain map 206. Controller 202 may ensure the path avoids previously excavated regions of site 114 and/or other impassable regions thereof. In one aspect, the machine operator may be prompted by controller 202, through monitor 116, or other available input devices, whether machine 100 should be moved autonomously to recommended position 312. Alternatively, the operator may be audibly prompted. The operator may authorize or decline autonomous movement by activating an appropriate operator input device.

If authorized, controller 202 may cause machine 100 to traverse the determined path by, for example, appropriately controlling fluid flow and pressure to actuators 106, a torque and/or speed output provided to driven traction devices 110, and/or a steering angle of steerable traction devices 112. Controller 202 may determine that recommended position 312 has been reached by machine 100 when the site coordinates of the current machine position are substantially equal to those of the recommended position 312. It is to be appreciated that the path may be defined such that an excavating end of machine 100 may be substantially aligned with a recommended orientation such that terrain within plan lines 308 is made available for excavation.

With further reference to FIGS. 4A-D, controller 202 may plan and recommend, by way of monitor 116, a sequence of excavation passes 400*a-d* at each of recommended machine positions 312*a-d*, respectively, to remove material from excavation site 114. Preferably, recommended sequence 400*a-d* may be graphically indicated on monitor 116. For example, controller 202 may cause an image or icon of linkage system 104 and/or implement 102 to move toward and enter current terrain 304 at a recommended point shown on monitor 116. Alternatively or in addition, controller 202 may graphically indicate regions to be swept out (excavated) by the sequences 400*a-d* by displaying appropriately-positioned, shaded, cross-hatched, and/or colored strips on monitor 116. It is to be appreciated that the recommended sequences 400*a-d* may be graphically indicated in other illustrative manners.

Controller 202 may determine and recommend the respective excavation sequences 400*a-d* based on the received location of obstacles 118, received machine position, received information regarding the predetermined task, received information regarding terrain of the excavation site 114, and known kinematics and geometry of implement 102 and/or linkage system 104. Additionally, this information may also be used by controller 202 to ensure implement 102 and/or linkage system 104 does not contact obstacles 118, enter tolerance zones 310, and/or breach plan lines 308 during excavation sequences 400*a-d*. Preferably, the recommended sequence of excavation passes may be planned such that a portion of desired terrain 306 within plan lines 308 may be achieved from a recommended position 312, without making unnecessary or redundant excavation passes. In other words, a targeted portion of earthen material may be removed in a minimum amount of passes.

For example, controller 202 may receive site coordinates of recommended position 312*a-d*, terrain information from terrain map 206, and/or obstacle location and tolerance zone information from system 208 and/or pre-existing map 216. Based on this information, controller 202 may design a sequence of excavation passes 400*a-d* to remove a volume of material associated with the respective position 312*a-d*, as discussed above. The sequence may define one or more adjacent paths from a starting point on current terrain 304 to an ending point thereof, such that when the ending point is reached (i.e. final pass in the sequence), a portion of desired terrain 306 is achieved within plan lines 308, and little, if any back excavation is required. Further, the excavation sequence may be determined such that implement 102 and linkage system 104 avoid obstacles 118 and tolerance zones 310 thereof throughout the process. Preferably, controller 202 may prohibit implement 102 and/or linkage system 104 from contacting obstacles 118 and/or tolerance zones 310 throughout the sequence.

Although the machine operator may manually perform the recommended excavation sequences 400*a-d* by appropriately manipulating the operator input devices, controller 202 may be configured to perform them autonomously. For example, the operator may be prompted, through monitor 116, to authorize autonomous completion of the recommended excavation sequences. The operator may authorize or decline autonomous excavation by activating an appropriate operator input device. Alternatively, the operator may be audibly prompted for authorization. If authorized, controller 202 may appropriately control the fluid flow and pressure supplied to actuators 106 in order to cause implement 102 and/or linkage system 104 to move in the recommended manner. Specifically, controller 202 may use the known kinematical and geometrical relationships between actuator lengths (or arm member angles) and implement 102 and/or linkage system 104 positioning in order to cause implement 102 and/or linkage system 104 to traverse the recommended excavation sequences.

In one embodiment, controller 202 may include and/or receive information concerning the known kinematics and geometry of implement 102 and/or linkage system 104. In other words, controller 202 may be aware of possible ranges of motion of implement 102 and/or linkage system 104. Controller 202 may also be aware of certain limitations or constraints on the motion thereof. For example, controller 202 may include data describing properties of implement 102 and/or linkage system 104, such as, a length, width, height, shape, possible rotation angles, volume, mass, etc., of each arm member 104*a-d*. Preferably, the kinematical and/or geometrical information may be stored in the microprocessors(s), memory, and/or secondary storage of controller 202 as hardware, software, and/or firmware.

For example, implement 102 and/or linkage system 104 may be modeled as a four-bar linkage including one free end (arm member 104*c*) and one fixed end (arm member 104*d*). Each arm member 104*a-d* may have a respective length and a pivot point around which it may rotate. A current position and orientation of implement 102 and linkage system 104 may be determined, in site coordinates, based on a length and an angle of rotation of each arm member 104*a-d* about its respective pivot point. Moreover, a range of possible positions and orientations of implement 102 and/or linkage system 104 may be determined, in site coordinates, based on the respective lengths of each arm member 104*a-d*, and possible rotational ranges thereof (i.e. each arm member 104*a-d* may have a given length, and a minimum and maximum angle of rotation).

External surface geometry of implement 102 and/or linkage system 104 may be similarly described in site coordinates. For example, a sampled surface of each arm member 104*a-d* may be defined by a plurality of surface vectors originating from a predetermined reference point, such as, for example, an origin on machine 100. The vectors, and by implication, the sampled surfaces of each arm member 104*a-d*, may also be defined as a function of an angle of rotation of each arm member 104*a-d*, and/or possible rotational ranges thereof. Therefore, controller 202 may be aware of the geometrical size, shape, and orientation of implement 102 and/or linkage system 104 at a given position and/or range of possible positions.

For example, on a given backhoe loader 100, arm member 104*a* (boom) may have a length of 18 feet and a 150-degree vertical range of rotation. Arm member 104*b* (stick) may have a length of 14 feet and a 120-degree vertical range of rotation. Arm member 104*c* (bucket) may have a length of 3 feet and a 205-degree vertical range of rotation. Further, arm member 104*a* may be connected to a swing pivot arm member 104*d* configured to rotate horizontally through a 90-degree swath at the rear of machine 100. Each arm member 104*a-d* may have a predetermined geometrical shape defined by a plurality of surface vectors as described above. In this manner, controller 202 may determine a volume of space that may be swept out in a given excavation pass, or any excavation pass, from a plurality of given machine positions. Consequently, controller 202 may be able to determine an amount of earthen material that may be removed by implement 102 from a given machine position, and therefore, an extent to which current work surface terrain 304 may be excavated toward desired terrain 306 from the position.

Preferably, known kinematics of implement 102 and/or linkage system 104 may be defined in terms of actuator 106 lengths. Actuators 106 may be hydraulic cylinders, or the like, and extendable between a minimum length and a maximum length in order to move linkage system 104 from maximum extended position to a minimum extended position, respectively. Therefore, a current actuator length and an available range of actuator lengths may directly correlate to a current angle of rotation and an available rotational range of arm members 104*a-d*, and, by implication, a current position and available range of positions of linkage system 104 and implement 102, respectively. The respective geometrical shape and orientation of each arm member 104*a-d* may therefore be defined with respect to actuator lengths, as discussed above. In one aspect, for example, actuator cylinder extension sensors (not shown) may be disposed on actuators 106 in order to provide signals to controller 202 indicative of lengths and/or available length ranges of actuators 106. Alternatively or in addition, angle sensors may be positioned on linkage system 104 in order to determine current angles of rotation and rotational ranges of each of arm member 104*a-d* and provide corresponding signals to controller 202.

One skilled in the art will realize that the apparatus and methods illustrated in this disclosure may be implemented in a variety of ways, in many different environments, and include multiple other types of machines 100, control systems 200, excavation sites 112, underground obstacles 118, tolerance zones 310, machine positioning determining systems 202, obstacle location detections systems 206, and recommended machine positions 312 that all functionally interrelate with each other to accomplish the individual tasks described above.

The scenario shown in FIGS. 4A-4E will be discussed further in the following section to illustrate practice of the disclosed control system 200.

INDUSTRIAL APPLICABILITY

The disclosed control system 200 finds potential application in scenarios where excavation in the vicinity of underground obstacles is necessary. Particularly, the disclosed control system 200 may be useful for positioning a machine 100 with respect to the underground obstacles and performing excavation efficiently and with minimal machine repositioning. The disclosed control system 200 may be particularly advantageous in situations where the locations of underground obstacles 118 are unknown, the operator of the machine is inexperienced, and/or excavation control is difficult. Several examples of utilizing the control system 200 will now be explained.

Referring to FIGS. 4A-4E, an operator of machine 100 on excavation site 114 may employ the disclosed control system 200 by activating an appropriate one or more of the operator control devices provided in operator cabin 108. Controller 202 may then receive signals from machine position determining system 204 indicating a current location of machine 100; signals from terrain map 206 indicating a layout of the work surface terrain at excavation site 114; and/or signals from terrain map 206 regarding a predetermined excavation task to be completed (i.e. plan lines 308 and/or specifications of excavation to be completed on site 114). Controller 202 may also receive signals from the machine operator by way of the operator input devices, such as, for example, manipulation of a joystick, indicating a desired excavation task to be completed by implement 102. Signals from obstacle location detection system 208 indicating a location, geometry, condition, and/or composition of underground obstacles 118 may also be received by controller 202. Further, controller 202 may receive signals from system 208 in order to determine and/or establish zones 310 associated with obstacles 118. Alternatively or additionally, controller 202 may receive this information from pre-existing map 216.

For example, controller 202 may receive a current location of machine 100 on excavation site 114. Signals from terrain map 206 may indicate plan lines 308 delineating a 30 feet long by 20 feet wide by 10 feet deep rectangular foundation to be dug at a certain location on site 114. Additionally, the signals from terrain map 206 may indicate that the targeted work surface terrain 304 is relatively flat. Further, signals from pre-existing map 216 may indicate that an underground water pipe 118*a*, 1 foot in diameter and 6 feet below the work surface 304, extends across a first side of site 114. Sensing performed by obstacle location detection system 208 may discover a second underground obstacle 118*b*—a plastic conduit, 1 foot in diameter and 4 feet below the work surface 304—extending across a second side of site 114. Accordingly, controller 202 may establish appropriate tolerance zones 310*a* (thin) and 310*b* (thick) around water pipe 118*a* and plastic conduit 118*b*, respectively.

Based on this information, and known kinematics and geometry of implement 102 and/or linkage system 104, controller 202 may then recommend a first machine placement position. For example, in one scenario, as shown in FIGS. 4A-4E controller 202 may recommend a first position 312*a* (FIG. 4*a*) on a long side of plan lines 308, substantially between obstacles 118*a* and 118*b*. Accordingly, controller 202 may cause an icon or an image of machine 100 to appear on monitor 116 in the recommended position 312*a*. The machine operator may then be prompted to authorize autonomous movement of machine to position 312*a*. The operator may accept or decline autonomous movement by activating an appropriate operator control device. If authorized, controller 202 may initiate appropriate machine control commands (i.e. fluid flow and pressure within hydraulic cylinders of actuators 106, torque and/or speed output to driven traction device 110, and/or steering angle output of steerable traction device 112, as discussed above) to automatically move machine 100 to position 312*a*. If declined, the operator may manually position machine 100.

Alternatively, the operator may override the prompt by activating an appropriate operator input device in order to remain at the current machine position or to move to another recommended machine position 312*a-d*. For example, controller 202 may list several available recommended positions

312*a*-312*d* on monitor 116. The positions may be ranked, for example, according to their efficiency, and the operator may be able to select, and initiate autonomous machine movement to, a desired position by activating an appropriate one or more operator input devices. In some instances, controller 202 may recommend positions that are not accessible due to structures proximate the excavation site 114 and/or other factors not accommodated for in terrain map 206, such as, for example, roads, pedestrians, trees, buildings, utility poles, property boundaries, etc. In such cases, the operator may be able to disable and/or decline the inaccessible positions using the operator input devices. Alternatively, the operator may manually enter the locations of such structures and/or factors using the one or more operator input devices. Accordingly, recommended locations may be disabled, and controller 202 may determine and recommend supplemental, albeit possibly less efficient, positions and corresponding excavation sequences to be used instead. Preferably, the supplemental recommended positions may be the most efficient available machine positions possible given the circumstances (i.e. structures and/or other factors).

Figure 4A:
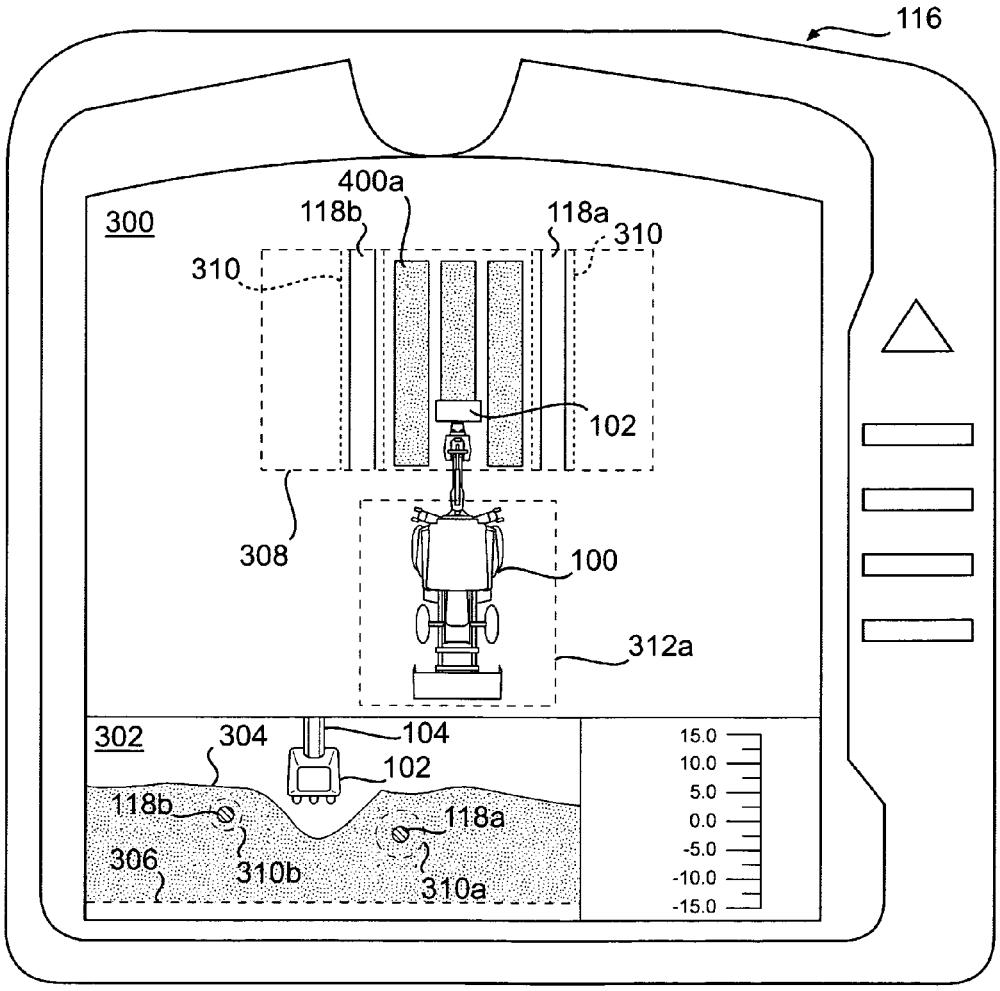
FIGS. 4A-4E are graphical representations of different recommended machine placements and respective recommended sequences of excavation passes in a given operational scenario for the excavation machine of FIG. 1.
Figure 4B:
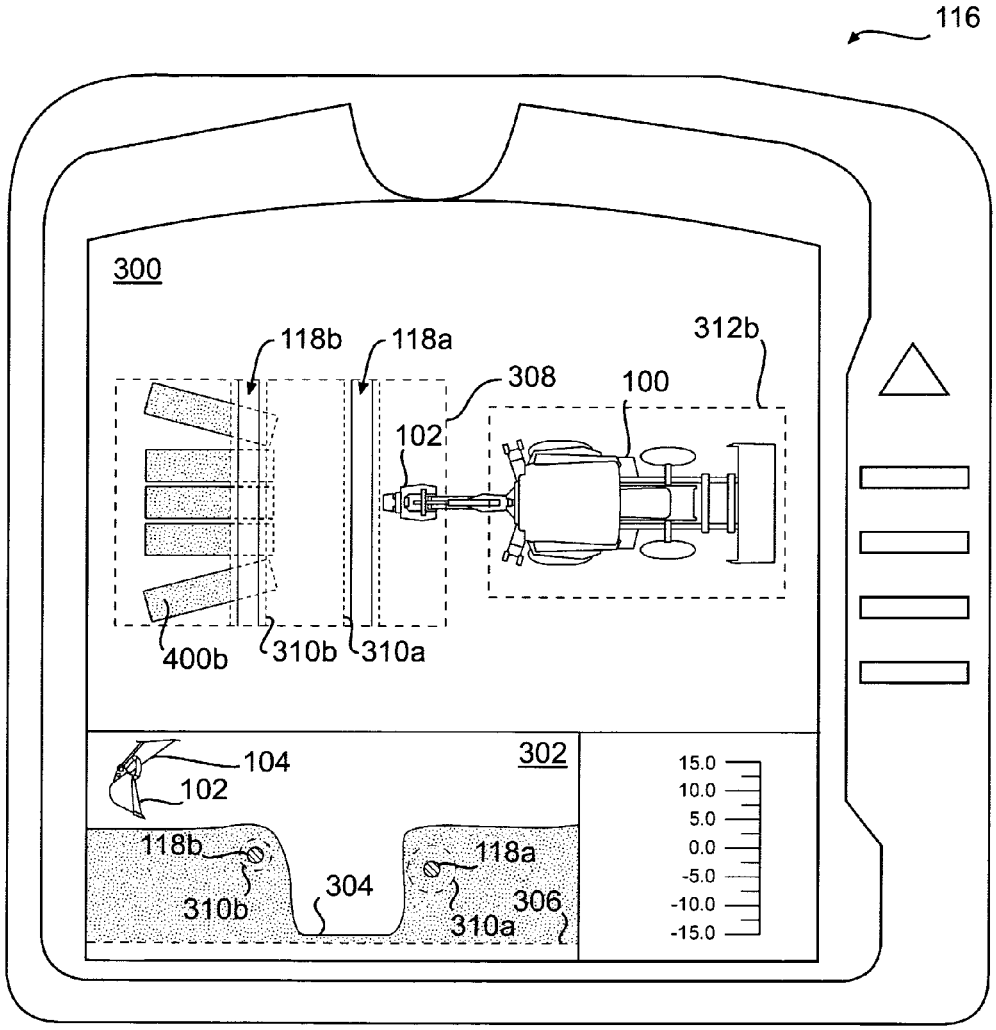
Figure 4C:
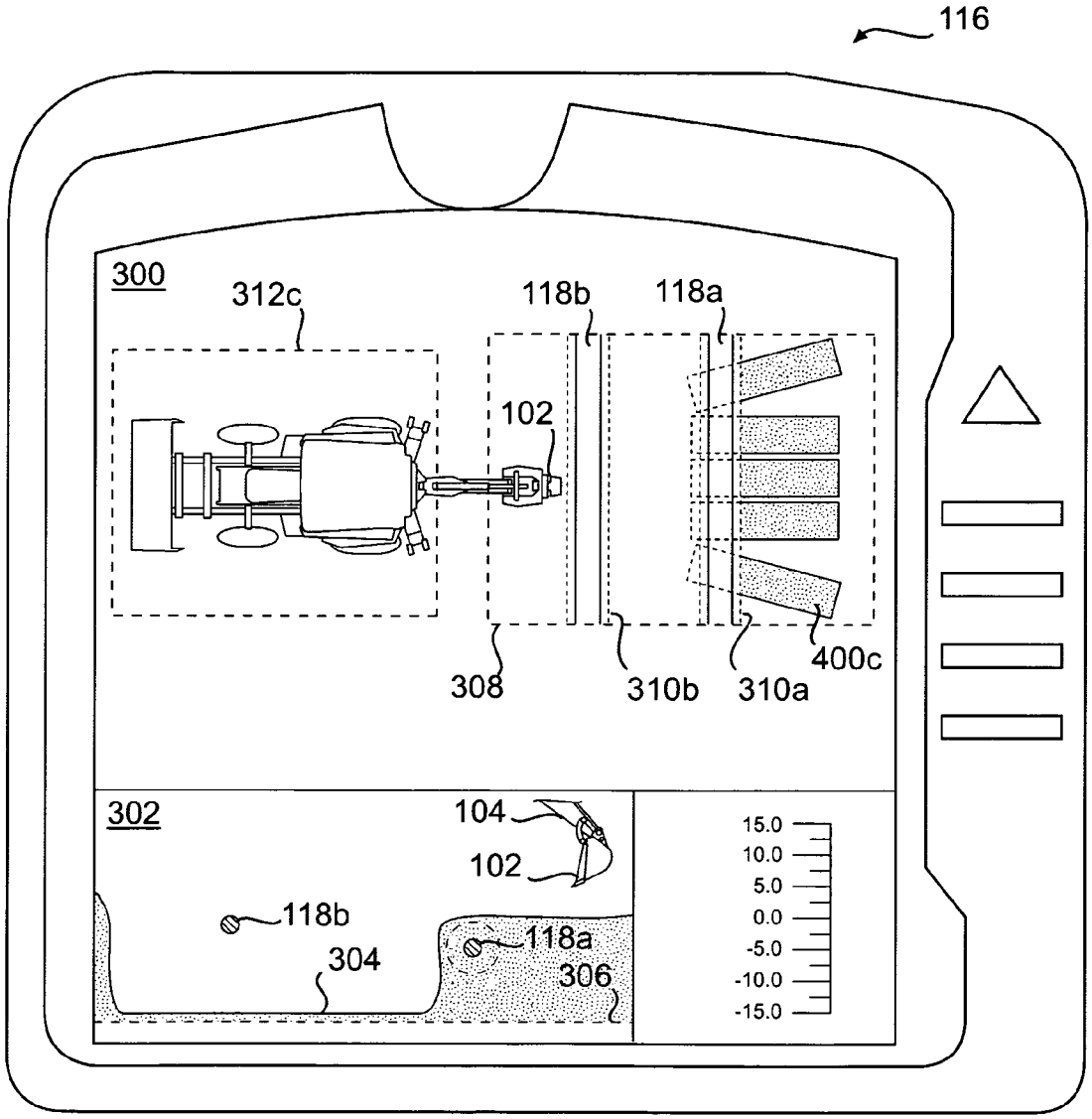

Once machine 100 is located at position 312*a*, controller 202 may then recommend a first sequence of excavation passes 500*a* to be completed from position 312*a*, which may be graphically illustrated on monitor 116. For example, as shown in FIG. 4*a*, excavation passes 500*a* may be substantially parallel to, and between, underground obstacles 118*a* and 118*b*. The operator may then be prompted to authorize autonomous completion of excavation passes 400*a*. If authorized, controller 202 perform the recommended sequence 400*a* by appropriately controlling fluid flow and pressure within the hydraulic cylinders of actuators 106. If declined, the operator may perform sequence 400*a* manually using the operator control devices, or override the prompt as discussed above Preferably, monitor 116 may display current work surface terrain 304 as material is removed throughout excavation sequence 400*a*. Upon completion of sequence 400*a*, a portion of desired terrain 306 may have been achieved between obstacles 118*a* and 1118*b*.

Subsequently, controller 202 may recommend a second machine placement position 312*b* (FIG. 4*b*), wherein machine 100 is substantially perpendicular to underground obstacles 118*a* and 118*b*, and on an obstacle 118*a*-side of excavation site 114. Position 312*b* may be graphically illustrated on monitor 116. As discussed above, the operator may be prompted with respect to autonomously relocating machine 100 to position 312*b*. Once machine 100 is location at position 312*b*, controller 202 may recommend a sequence of excavation passes 500*b* to be completed from position 312*b*, which may be graphically illustrated on monitor 116, as discussed above. The operator may then be prompted with respect to autonomously performing the recommended sequence 400*b*, as discussed above. Upon completion of sequence 400*b*, a portion of desired terrain 306 on a far side and/or beneath obstacle 118*b* may have been achieved.

Subsequently, controller 202 may recommend a third or final machine placement position 312*c* (FIG. 4*c*), wherein machine 100 is again substantially perpendicular to underground obstacles 118, but on an obstacle 118*b*-side of excavation site 114. Position 312*b* may be graphically illustrated on monitor 116. As discussed above, the operator may be prompted with respect to autonomously relocating machine 100 to position 312*c*. Once machine 100 is located at position 312*c*, controller 202 may recommend a sequence of excavation passes 400*c* to be completed from position 312*c*, which may be graphically illustrated on monitor 116, as discussed above. The operator may then be prompted with respect to autonomously performing the recommended sequence 400*c*, as discussed above. Upon completion of sequence 400*c*, a portion of desired terrain 306 on a far side and beneath obstacle 118*a* may have been achieved.

Figure 4D:
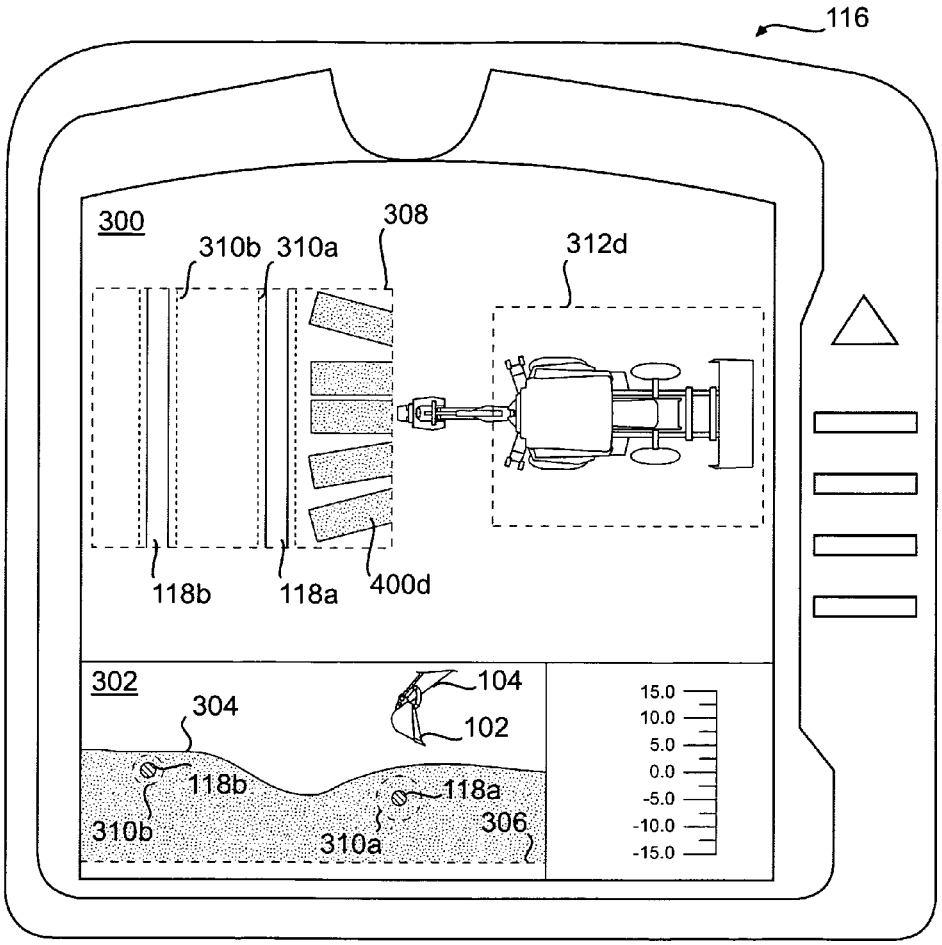
Figure 4E:
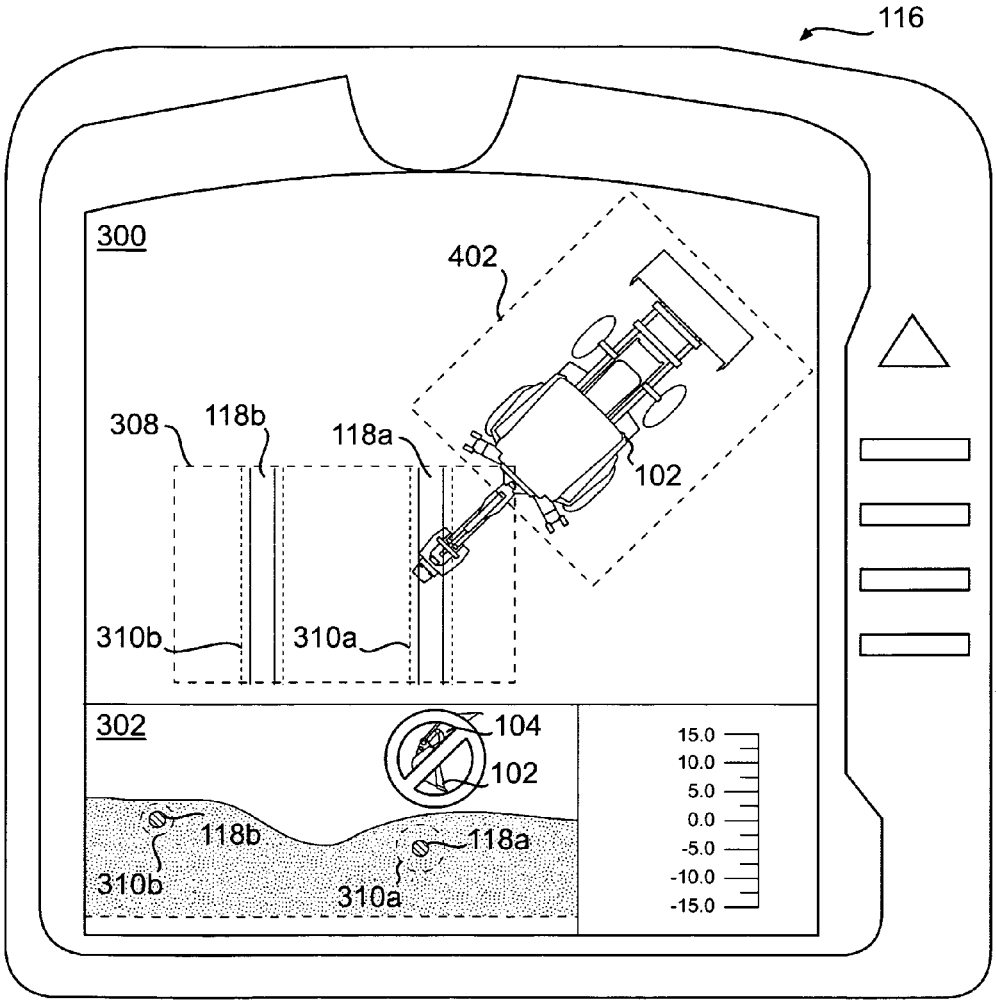

In one aspect, controller 202 may determine, based on tolerance zone 310 information, that excavation passes may not be made in a direction substantially toward obstacle 118*a* (i.e. obstacle 118*a* is delicate). In such a situation, controller 202 may recommend a machine placement position 312*d* (FIG. 4*d*). Further, controller 202 may recommend a sequence of excavation passes 400*d* in directions substantially away from obstacle 118*a*. As shown by FIG. 4*d*, sequence 400*d* may not extend behind nor under obstacle 118*a*, and therefore, material may not be removed by machine 100 in these locations due to kinematical and geometric constraints of implement 102 and/or linkage system 104. Therefore, a portion of desired terrain 306 may not be achieved beneath obstacle 118*a*, and material may have to be removed by hand or with a handheld tool.

In a further aspect, an operator may arbitrarily choose a machine position 402 (FIG. 4*e*) with respect to plan lines 308 on excavation site 114. In such a position 402, excavation may not be practical, or even possible, without striking obstacles 118 and/or tolerance zones 310 thereof. In such a situation, controller 202 may provide a warning to the operator by way of monitor 116. For example, a colored flashing image of implement 102 and/or linkage system 104 may appear on monitor 116. Alternatively, the warning may be audibly provided to the operator. Preferably, controller 202 may prohibit attempted excavation from position 402 and prompt the operator with an alternative recommended machine position, such as, for example, one of positions 312*a*-*d*. The operator may either accept, and relocate machine 100 to one of the recommended machine positions 312*a*-*d* as discussed above, or decline, and perform excavation from position 402 notwithstanding the warning.

As such, the operator may be provided with the option of performing excavation from recommended machine positions 312*a*-*d*, instead of struggling with arbitrary machine position 402, where excavation may be difficult, inefficient, and/or cause damage to underground obstacles 118. Additionally, the operator may not be required to attempt to independently position machine 100, through trial and error, such that productive amounts of material may be removed in spite of obstacles 118. Instead, the operator may rely on recommended machine positions 312*a*-*d* and recommended excavation sequences 400*a*-*d* in order to efficiently accomplish excavation without damage to obstacles 118.

It will be apparent to those skilled in the art that various modifications and variations may be made to the disclosed machine 100, controller 202, machine position determining system 204, obstacle location detection system 208, recommended machine positions 312, or any other features disclosed. Other embodiments will be apparent to those skilled in the art from consideration of the specification and practice of the disclosed control system. It is intended that the specification and examples be considered as exemplary only, with a true scope being indicated by the following claims and their equivalents.

What is claimed is:

1. A control system for a machine operating at an excavation site, the control system comprising:

a positioning device configured to determine a position of the machine; and a controller in communication with the positioning device, the controller configured to:

receive information regarding an excavation task for the machine;

receive the machine's position;

receive a location of an obstacle at the excavation site; and determine a placement of the machine on a surface of the excavation site from which the machine can accomplish the excavation task, based on the received machine position and the received obstacle location.

2. The control system of claim 1, wherein the machine has an implement and the machine placement determination is based further on known kinematics and geometry of the implement.

3. The control system of claim 2, wherein the controller is further configured to determine and recommend a sequence of excavation passes for the implement to accomplish the excavation task based on the received machine position, obstacle location, and known kinematics and geometry.

4. The control system of claim 2, wherein the controller is further configured to determine if accomplishment of the excavation task is possible based on the received machine position, obstacle location, and known kinematics and geometry, and to inform an operator of the machine of the determination.

5. The control system of claim 1, wherein the controller is further configured to autonomously move the machine to the determined machine placement.

6. The control system of claim 1, wherein the controller is further configured to receive information regarding terrain of the excavation site.

7. The control system of claim 1, wherein the machine placement determination is based further on a tolerance zone around the obstacle position and a condition of material within the tolerance zone.

8. The control system of claim 7, wherein the machine placement determination is based further on a predicted force transmitted into the tolerance zone during completion of the excavation task.

9. The control system of claim 7, wherein the tolerance zone is based further on a known composition of the obstacle.

10. The control system of claim 1, further including a locating device onboard the machine and in communication with the controller, the locating device determining the obstacle position.

11. The control system of claim 1, further including a monitor onboard the machine, the controller further in communication with the monitor and further configured to display, on the monitor, the excavation site with the determined machine placement illustrated thereon.

12. The control system of claim 11, the controller further configured to update and to display excavation site terrain on the monitor during completion of the excavation task.

13. A method of controlling an excavating machine operating at an excavation site, the excavating machine having a work implement and a controller, the method performed by the controller and comprising:

receiving a position of the excavating machine;

receiving a location of an obstacle at the excavation site;

receiving information regarding an excavation task for the excavating machine; and determining a placement of the excavating machine on a surface of the excavation site from which the excavating machine can accomplish the excavation task, based on the received machine position and the received obstacle location.

14. The method of claim 13, further including receiving kinematics and geometry of the implement of the excavating machine, wherein the machine placement determination is based further on the kinematics and the geometry.

15. The method of claim 14, further including recommending a sequence of excavation passes for the implement to accomplish the excavation task based on the machine position, obstacle location, and kinematics and geometry.

16. The method of claim 14, further including:

determining if accomplishment of the excavation task is possible from the received machine position, based on the obstacle location, kinematics, and geometry; and informing an operator of the excavating machine of the determination.

17. The method of claim 13, further including autonomously moving the excavating machine to the determined machine placement.

18. An excavating machine, comprising:

a work implement having known kinematics and geometry;

a positioning system configured to determine a position of the excavating machine and the work implement;

a monitor located onboard the excavating machine and configured to display the position of the excavating machine and the work implement relative to a work surface;

an input device configured to receive information regarding a predetermined task for completion by the work implement; and a controller in communication with the locating system, the positioning device, and the monitor, the controller being configured to:

receive the excavating machine's position;

receive the known kinematics and geometry;

receive a location of an obstacle at the excavation site;

receive the information regarding the predetermined task;

recommend placement of the excavating machine to accomplish the predetermined task based on the received machine position, known kinematics and geometry, and obstacle location;

recommend a sequence of excavation passes for the work implement to accomplish the predetermined task based on the received machine position, known kinematics and geometry, and obstacle location; and display on the monitor the recommended placement of the excavating machine, the recommended sequence of excavation passes, and terrain of the excavation site during completion of the predetermined task.

19. The excavating machine of claim 18, wherein the controller is further configured to:

determine if accomplishment of the predetermined task is possible from the received machine position, based on the obstacle location and known kinematics and geometry; and inform an operator of the excavating machine of the determination.

20. The excavating machine of claim 18, wherein the controller is further configured to autonomously move at least one of the excavating machine and the work implement to accomplish the predetermined task.

* * * * *